United States Patent [19]

Chien

[11] Patent Number: 5,049,024

[45] Date of Patent: Sep. 17, 1991

[54] REFUSE COLLECTION AND DELIVERY SYSTEM

[76] Inventor: Chung M. Chien, No. 69, Kuo Jung Rd., I-Lan, Taiwan

[21] Appl. No.: 496,641

[22] Filed: Mar. 21, 1990

[51] Int. Cl.[5] ..... B65F 3/02

[52] U.S. Cl. ..... 414/404; 414/406; 414/407; 220/908

[58] Field of Search ..... 414/404, 406, 407, 411, 414/414, 419, 421; 220/908

[56] References Cited

U.S. PATENT DOCUMENTS

| | | | |
|---|---|---|---|
| 1,026,465 | 5/1912 | Scholz | 414/407 X |
| 3,417,888 | 12/1968 | Naab | 414/407 |
| 3,747,785 | 7/1973 | Dahlin | 414/406 X |
| 3,786,949 | 1/1974 | Sutton | 414/406 |
| 4,085,857 | 4/1978 | Smith | 414/407 |
| 4,290,352 | 9/1981 | Schmidt et al. | 414/406 X |
| 4,450,828 | 5/1984 | Onken et al. | 414/406 X |
| 4,863,053 | 9/1989 | Oberg | 414/407 |

FOREIGN PATENT DOCUMENTS

| | | | |
|---|---|---|---|
| 1026494 | 2/1953 | France | 414/404 |
| 55909 | 5/1976 | Japan | 414/406 |
| 284308 | 11/1952 | Switzerland | 414/404 |

*Primary Examiner*—Robert J. Spar
*Assistant Examiner*—Brian K. Dinicola
*Attorney, Agent, or Firm*—Asian Pacific International Patent and Trademark Office

[57] ABSTRACT

A refuse collection and delivery system, which includes a garbage can for collection garbage and a garbage truck for receiving and delivering the garbage collected from the garbage can. The garbage can includes a horizontal type cylinder having an opening covered with a sliding cover which has lifting-eyes thereon for the fastening therein of the hooks of a crane of the garbage truck to lift the garbage can to a dustbin tipping device thereof for dust-free tipping operation.

5 Claims, 6 Drawing Sheets

REFUSE COLLECTION AND DELIVERY SYSTEM

BACKGROUND OF THE INVENTION

The present invention is related to a refuse collection and delivery system and more particularly to a system which utilizes a garbage truck to mate with specially designed garbage cans.

Regular public garbage cans are generally impractical in use because they can be overloaded to an overflowed condition. They are inconvenient to clean and tend to produce odor and environmental pollution. It is more difficult to hire people to collect garbage from regular public garbage cans.

The disadvantages of the conventional refuse collection and delivery system are outlined as hereinafter.

1. Inconvenience: Regular city garbage trucks are arranged for collecting garbage according to fixed schedule and can not flexibly meet people's requirements.

2. Unsanitary: Whether placed on fixed posts or on the ground in front of the door of each house, the refuse matter is exposed to the sun and tends to produce pollution. During the collection of garbage, the workers are inevitably in contact with waste materials so as to inhale polluted air.

3. Uneconomical: According to investigation, 50–80% of the total refuse disposal budget is used for garbage collection and delivery operation and only lesser percentage is used for the treatment of garbage.

4. Against environmental protection: It tends to pollute the environment when bags of garbage are placed collectively on a location or in front of the door of each house for further collection and delivery by garbage trucks.

SUMMARY OF THE INVENTION

One object of the present invention is to provide a refuse collection and delivery system which utilizes a crane and a dustbin tipping device on a garbage truck to efficiently carry a dust can for dust-free garbage emptying operation through the operation of hydraulic power, permitting such a dust can to be repeatedly used.

Another object of the present invention is to provide a refuse collection and delivery system which minimizes manpower consumption and which is safe and practical in use.

Still another object of the present invention is to provide a refuse collection and delivery system which can efficiently protect against environmental pollution.

BRIEF DESCRIPTION OF THE DRAWINGS

The present invention will now be described by way of example, with reference made to the attached drawings, in which.

DETAILED DESCRIPTION OF THE PREFERRED EMBODIMENTS

Figure 1:
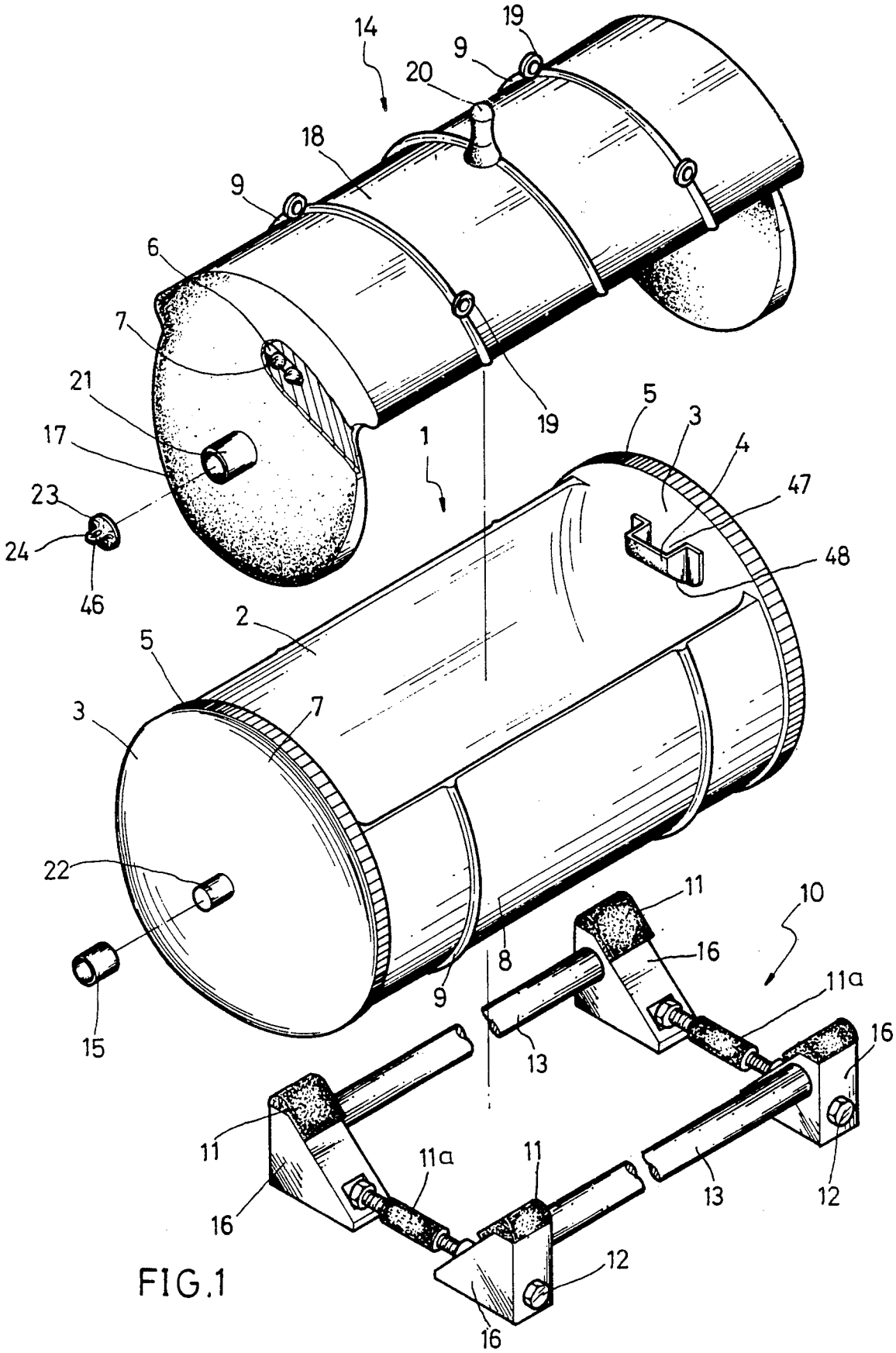
FIG. 1 is a perspective fragmentary view of a garbage can in accordance with the present invention.
Figure 7:
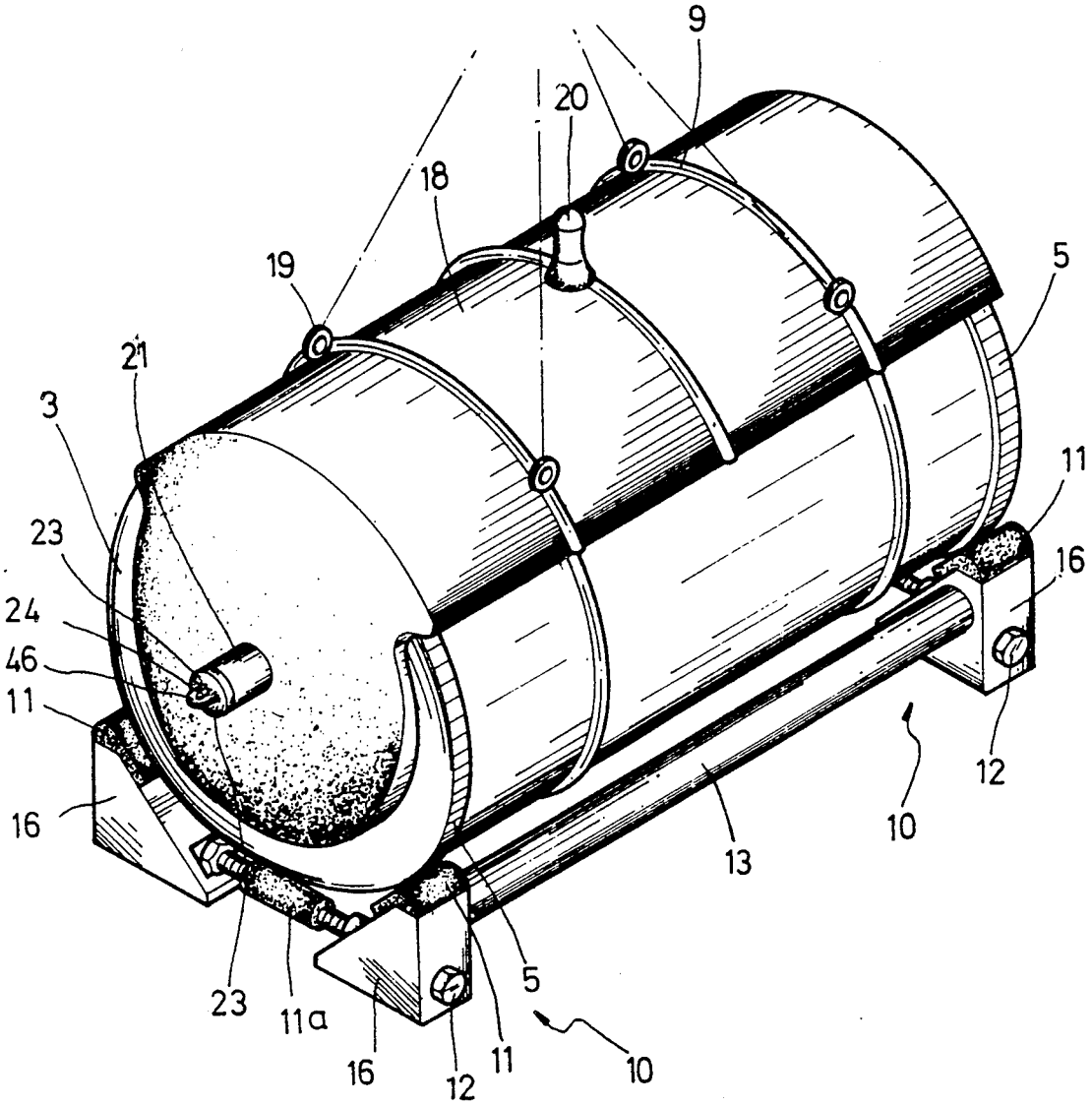
FIG. 7 is a perspective view of the garbage can of FIG. 1.

Turning now to the attached drawings in greater detail and referring first to FIG. 1, therein illustrated is a garbage can in accordance with the present invention and generally comprised of a horizontal type cylinder (1) that includes a cylindrical wall having a top opening (2). The smooth circular inner wall surface of the cylindrical wall facilitates complete discharge of the garbage. A cigarette extinguisher (4) is internally mounted on each of the two end walls (3) of the cylinder (1). Each extinguisher contains water so that any cigarette butt can be extinguished when it is thrown therein. The two end walls (3) of the cylinder (1) each comprise a toothed portion (5) around its periphery, and an axle (22) extending outward along the cylinder axis within a self-lubricating bearing (15). A plurality of unitary, reinforced ribs (9) are extended around the circular body (8) of the cylinder (1) to strengthen the structure. There is also provided a stand (10) to support the cylinder (1), which includes four supporting blocks (16) set at four corners and covered with a rubber cushion (11) each on the top for engagement with the toothed portions (5) of the cylinder (1) so as to resist the pressure of heavy load. The supporting blocks (16) are transversely and fixedly connected by means of two fixed rods (13) and longitudinally and adjustably connected by means of two adjusting screws (12), wherein the adjusting screws (12) are each covered with a rubber cushions 11*a* to protect against impact. A sliding cover (14) is mounted on the cylinder (1) to cover the opening (2). The cover includes an arcuate segmental wall 18 and two end walls 17. The thickness of each end wall is gradually increased from the top connection point with wall 18 to its lower arcuate edge. Therefore, the center of gravity of the sliding cover (14) is on its lower bottom. The two end walls (17) of the sliding cover (14) comprise each a curved groove (6) on the inner wall surface at an upper position and having set therein several rolling balls (7). The arcuate segmental wall (18) of the sliding cover (14) has a width slightly wider than the width of the opening (2) of the cylinder (1). A plurality of unitary, reinforced ribs (9) are formed around the outer surface of the wall (18) to reinforce the cover structure. Two pair of lifting-eyes (19) are extended from the reinforced ribs (9) so that the garbage can can be stably lifted by means of strap and hooks. A handlebar (20) is centrally located on the top of wall (18) of the sliding cover (14) for the holding of the hand to slide open the sliding cover (14). A sleeve (21) extends from each cover end wall (17) of the sliding cover (14) around an axle 22. As shown in FIG. 7, each sleeve carries a self-lubricating plate (23), which self-lubricating plate (23) comprises a lug (46) having a hole (24) therethrough for the fastening therein of a safety chain to secure the sliding cover (14) to the ground. The sliding overlie (14) is specially designed to constantly cover the opening (2) of the cylinder (1). As soon as pull force is released from the sliding cover (14) after it is opened, it immediately returns to the original closed position to protect the collected garbage therein against weather or being littered by wild dogs or cats. Because the center of gravity of the sliding cover (14) is on its lower bottom and because of the arrangement of the rolling balls (7) on the two side boards (17) and the self-lubricating bearings (15) between the axles (22) of the cylinder (1) and the sleeves (21) of the sliding cover (14), the sliding cover (14) can be smoothly and easily turned to open and automatically close up each time after it is opened. Therefore, no return spring is required to pull back the sliding cover (14), thereby eliminating material fatigue as a problem.

Figure 2:
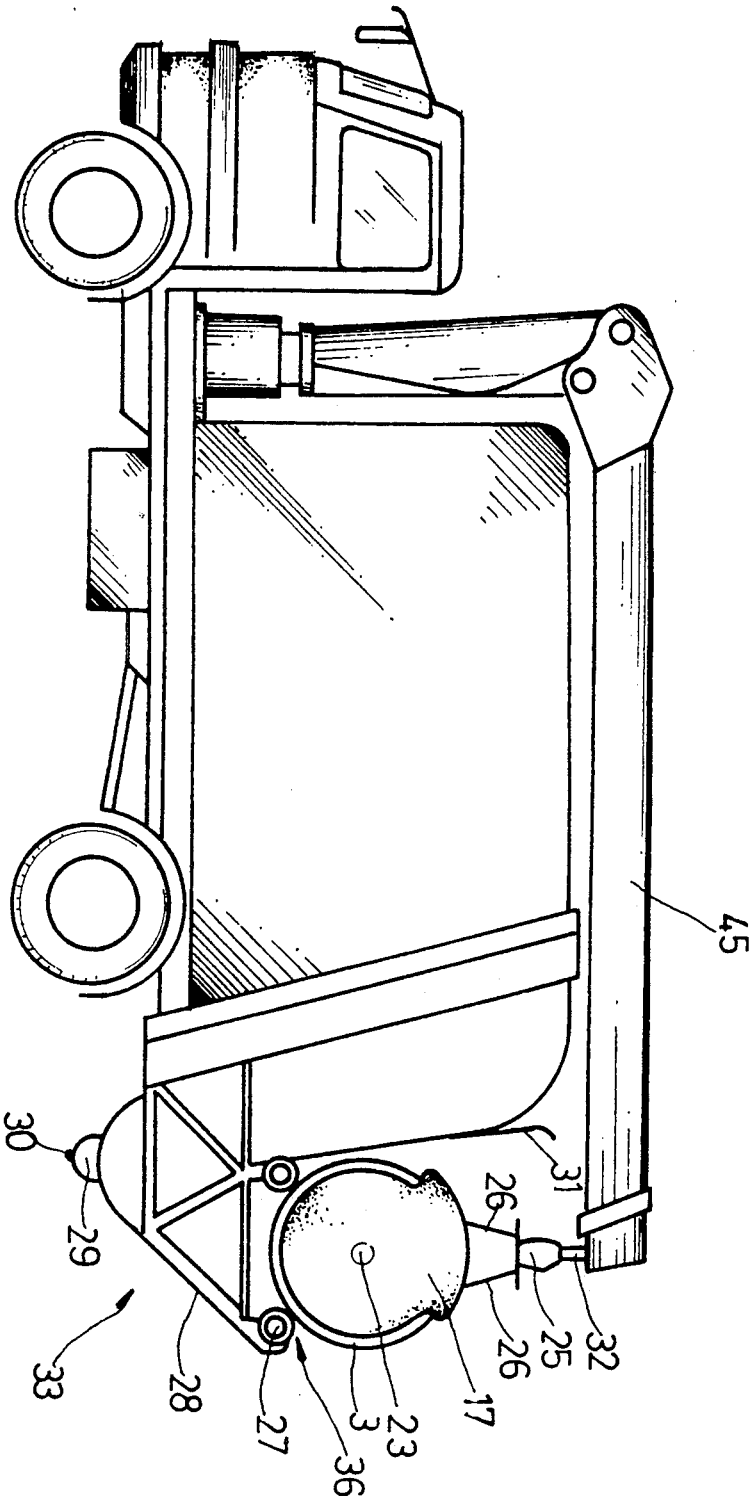
FIG. 2 is a schematic drawing of a garbage truck according to the present invention, in which a garbage can of the present invention is lifted by a crane to place on a dustbin tipping device for dustbin tipping operation.
Figure 3:
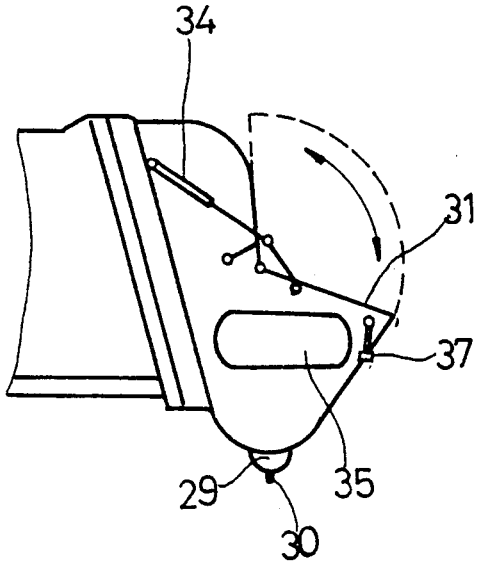
FIG. 3 is a schematic drawing, illustrating the structure of a dustbin tipping device according to the present invention.
Figure 4:
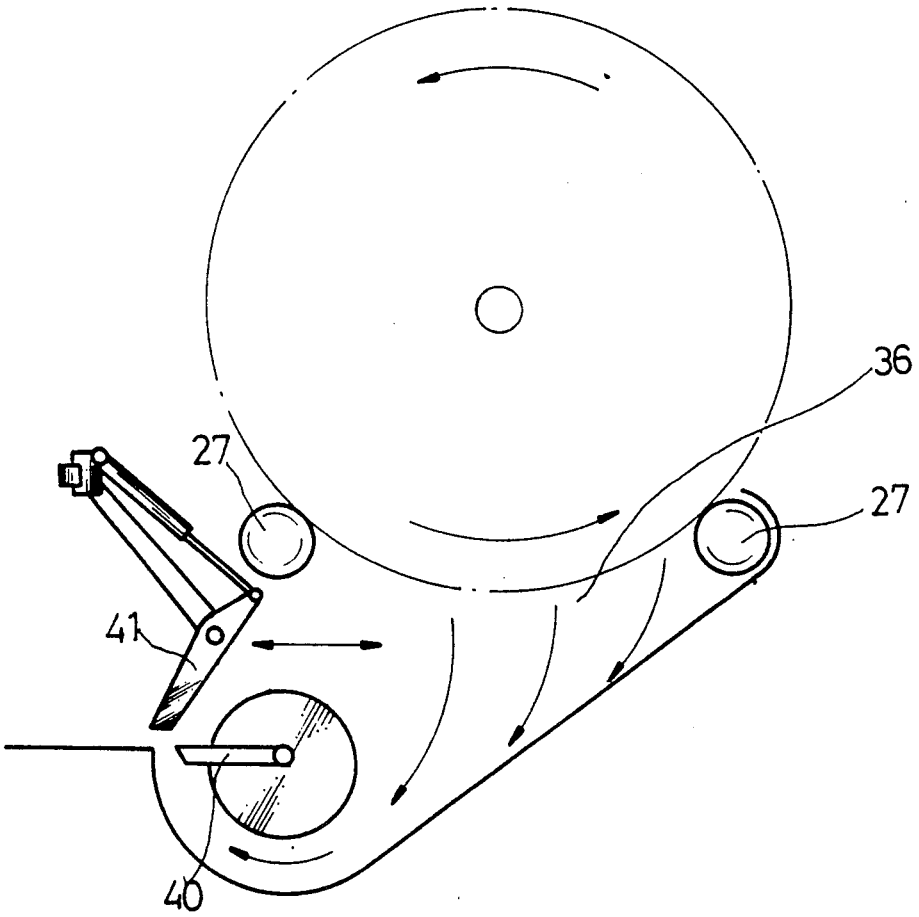
FIG. 4 is a schematic drawing, illustrating the operation of the feed-in mechanism of the dustbin tipping device according to the present invention.
Figure 5:
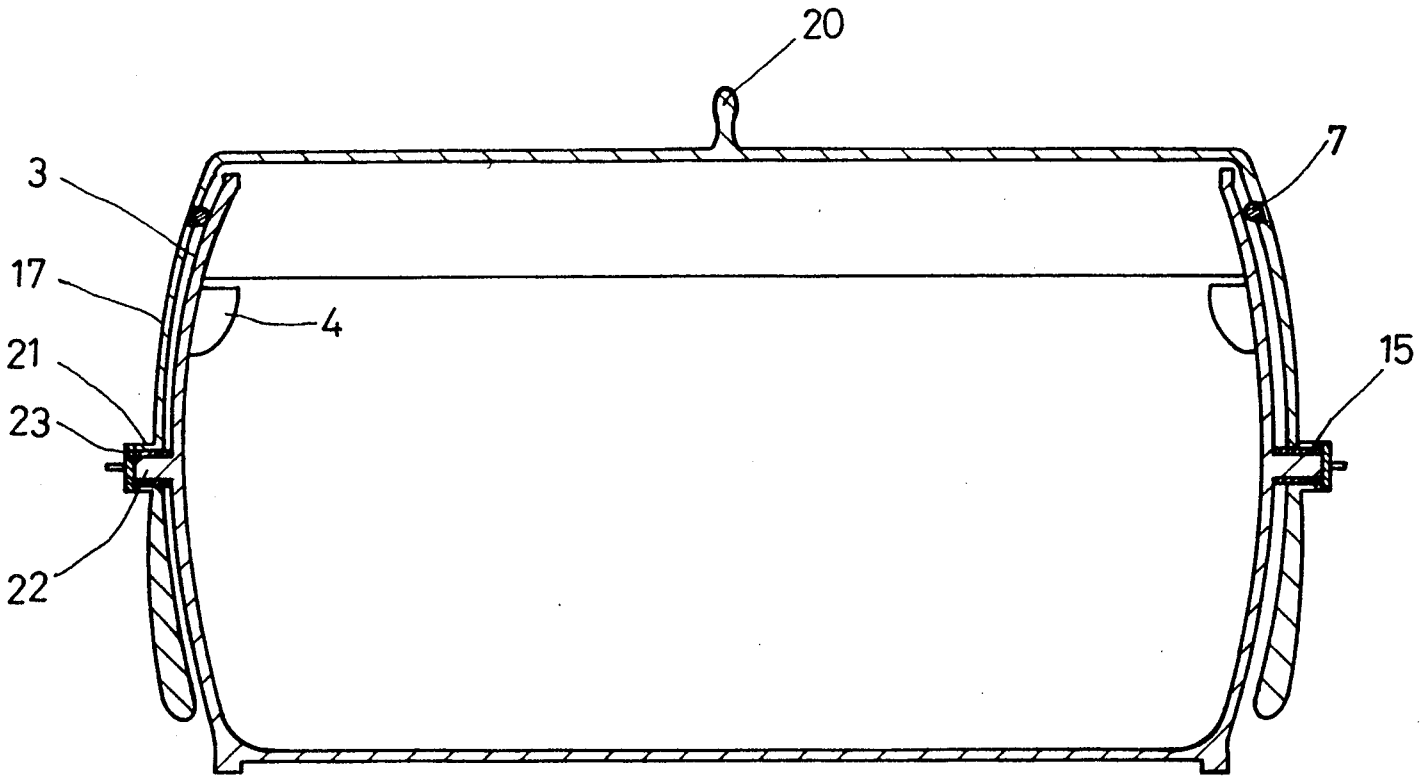
FIG. 5 is a sectional assembly view of the garbage can of FIG. 1.
Figure 6:
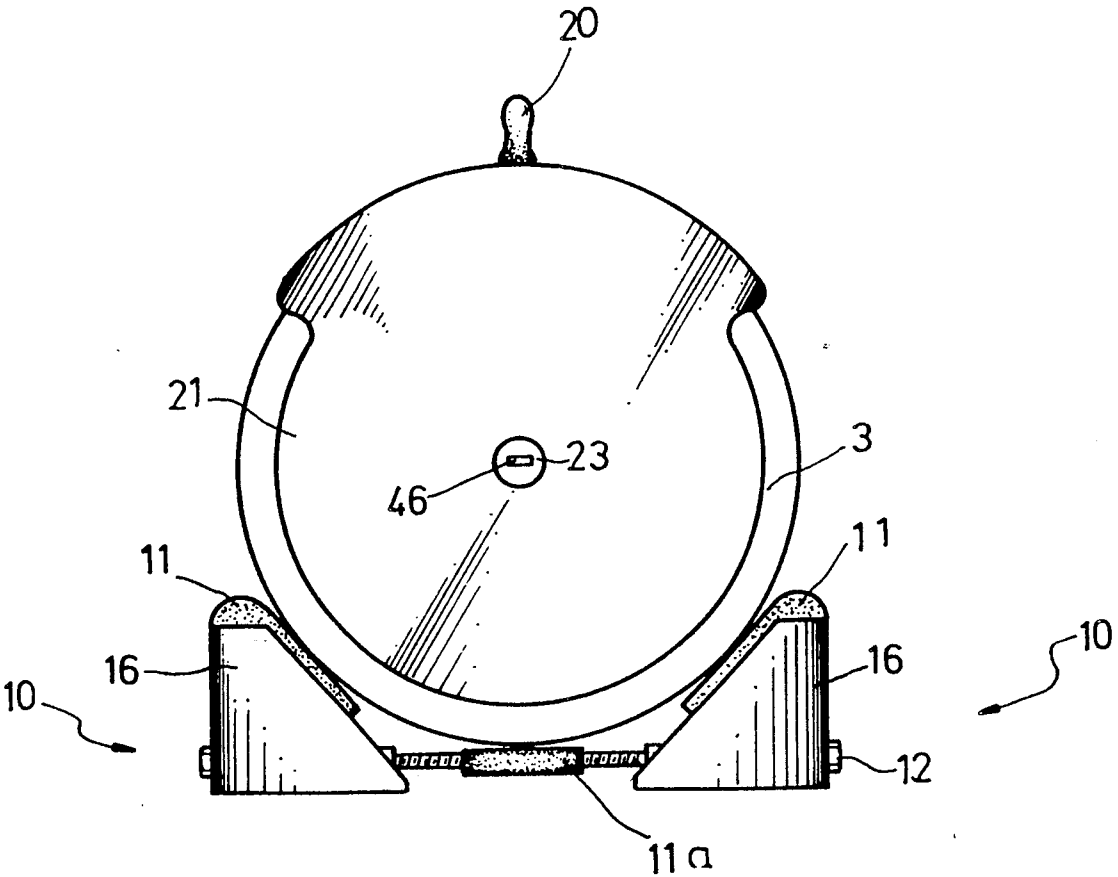
FIG. 6 is a side view of the garbage can of FIG. 1 taken in direction through the side boards thereof.

Referring to FIG. 2, there is illustrated a garbage truck in accordance with the present invention, which comprises a dustbin tipping device (33) on its rear side. The dustbin tipping device (33) comprises a lid (31) (see FIG. 3) having bilaterally a pair of hydraulic cylinders (34) thereon. The lid (31) of the dustbin tipping device (33) is controlled to open or close by means of push-button control. A squint window (35) is located in each one of the side walls of the dustbin tipping device (33). A water reservoir (29) is made on the bottom of the dustbin tipping device (33).

The refuse collection and delivery operation of the present invention is outlined as hereinafter:

1. Release the hooks (not shown) of the cable crane (45);

2. Turn the cable crane (45) to a suitable position above the garbage can and lower the tackle (25) permitting hooks to hook on the lifting-eyes (19) of the sliding cover (14);

3. Press open the cover (31) of the dustbin tipping device (33);

4. Pull back the cable of the cable crane (45) until the detecting part (32) is firmly stopped (the cable of the cable crane (45) is mounted on a fixed location and arranged in a fixed length);

5. Turn the cable crane (45) to the right back side of the garbage truck to place the garbage can on the four bearing wheels (27) of the dustbin tipping device (33);

6. Start the bearing wheels (27) of the dustbin tipping device (33) to overturn the opening of the garbage can vertically to a downward position (it can be clearly seen through the squint windows (35)) and simultaneously turn on the feed-in mechanism (40) and (41) to drag the garbage inside the garbage truck. A wooden hammer may be used to strike over the reinforced ribs of the garbage can to shake down the garbage during dustbin tipping operation. As soon as garbage is completely emptied, the garbage can is moved back to place on the stand (10) by means of repeating the afore-said procedures reversely. After the cable crane (45) of the garbage truck is turned back to original position and firmly fixed, the garbage truck is moved to another dust collection post for collecting dust or to a refuse disposal center or destructor plant for treatment.

The present invention can provide numerous advantages which are outlined hereinafter.

1. After garbage is emptied, the garbage can can be directly lifted without turning back the cylinder of the garbage can. Because the cylinder of the garbage can is specially designed in such a manner that its front side is heavier than its back side and its lower bottom is heavier than its upper portion, as soon as the garbage can is lifted from the bearing wheels of the dustbin tipping device, it turns automatically to a right position with the opening of its cylinder disposed upward and covered by its sliding cover. Therefore, garbage can be efficiently protected from contact with operators or the outer surface of the garbage can and the garbage truck, and environmental pollution problem can be eliminated.

2. The design of the toothed portions of the cylinder of the garbage can ensures the engagement of the garbage can with the rubber cushions of the stand or the bearing wheels of the dustbin tipping device. Therefore, the garbage can can be efficiently carried by the bearing wheels to dump garbage or firmly positioned on the stand. The rubber cushions of the stand can protect the garbage can from damage during lifting or positioning operation.

3. The design of the hydraulic cylinders of the dustbin tipping device provides satisfactory output capacity for efficiently lifting the heavy garbage can with minimized noise level and the operation of which is simple, accurate and safe. Further, the maintenance of which is also easy.

4. When the garbage can is lifted to a position above the stand for positioning each time after dustbin tipping operation, it can be held by the hand to a right position for allocation or the stand can be pushed to a right position directly below the suspended garbage can.

5. After the garbage can is placed back, insecticide or deodorant is sprayed or filled in the cylinder to clean the garbage can and the cigarette extinguisher of the cylinder is filled with water for extinguishing cigarette butt. The organic waste water from the water reservoir of the dustbin tipping device can be utilized to fertilize the soil of potted plants.

6. The crane of the garbage truck can be turned toward the direction of the head of the truck to stabilize the garbage truck during garbage dumping operation in a refuse disposal center or destructor plant (because the garbage dumping ground of a refuse disposal center or destructor plant is generally loose and uneven due to accumulation of garbage, a garbage truck may lose its balance to turn over or slide down during dumping operation).

As indicated, the present invention may be variously embodied. Recognizing that various modifications been apparent, the scope herein shall be deemed as defined in the claims set forth hereinafter.

What is claimed is:

1. A refuse collection and delivery system, including a garbage can, a stand for the garbage can, and a garbage truck:

said garbage can comprising a horizontal cylindrical wall defining the can central axis, and two circular end walls extending normal to said central axis at opposite ends of said cylindrical wall; said cylindrical wall having an upwardly facing opening extending therealong for placement of garbage into the can; said circular end walls having peripheral edges formed with drive teeth extending therealong to facilitate overturnment of the garbage can for emptying purposes; a stub axle extending from each end wall on the can central axis;

a slidable cover for said garbage can, comprising an arcuate segmental main wall coextensive in length with the garbage can, and two end walls extending normal to said arcuate wall alongside a respective one of the can end walls; each cover end wall having a sleeve telescoped onto one of said stub axles whereby the cover can be rotated around the can central axis to alternately expose or cover the can opening; the thickness of each cover end wall being relatively small at its connection point to the cover main wall and being relatively great at a point diammetrically spaced from said connection point so that the center of gravity of the cover is lowered to cause the cover to be gravitationally biased to a position overlying the can opening; a plurality of lifting eyes extending from the cover main wall at axially spaced points therealong;

said stand comprising faces upright blocks spaced apart in a rectangular pattern, and connector means extending between said blocks to form a rigid unitary cradle structure for supporting the garbage can in a horizontal attitude; and a resilient cushion carried on each block for engagement with the undersurface of the can;

said garbage truck comprising a block and tackle means having a hook structure engageable with said lifting eyes, whereby the cover and garbage can are liftable as a unit from the stand; an upwardly open bin structure (33); a lid (31) normally closing said bin structure; power means (34) for moving the lid structure to an open position; and two pairs of horizontal axis drive wheels (27) located at the mouth of the bin structure to mate with the drive teeth on the garbage can when the block and tackle means is operated to lower the garbage can toward the bin structure; said drive wheels being rotatable to overturn the garbage can while the cover remains in a stationary position above the bin structure, whereby garbage is discharged from the overturned can into the bin structure.

2. The collection and delivery system of claim 1, and further comprising two circumferential structural reinforcement ribs on the cover; said lifting eyes including two spaced lifting eyes on one of said ribs and two additional lifting eyes on the other rib.

3. The collection and delivery system of claim 1, and further comprising an anti-friction guide means between each cover end wall and each adjacent can end wall; each anti-friction guide means comprising an arcuate groove on one of said end walls and a plurality of anti-friction balls rotatably positioned in said groove.

4. The collection and delivery system of claim 1, and further comprising means in the garbage can for extinguishing cigarette butts; said extinguishing means comprising a water containment device on one of the garbage can end walls near the plane of the can opening.

5. The collection and delivery system of claim 1, and further comprising an observation window on a wall of the dust bin structure, whereby a person can observe the garbage discharge action achieved by overturnment of the garbage can.

* * * * *